US008998783B2

(12) United States Patent
Orenstein

(10) Patent No.: US 8,998,783 B2
(45) Date of Patent: Apr. 7, 2015

(54) PUSH UP DEVICE

(71) Applicant: The Prophet Corporation, Owatonna, MN (US)

(72) Inventor: Amber Orenstein, Prior Lake, MN (US)

(73) Assignee: The Prophet Corporation, Owatonna, MN (US)

( * ) Notice: Subject to any disclaimer, the term of this patent is extended or adjusted under 35 U.S.C. 154(b) by 139 days.

(21) Appl. No.: 13/715,530

(22) Filed: Dec. 14, 2012

(65) Prior Publication Data

US 2014/0171278 A1 Jun. 19, 2014

(51) Int. Cl.

| | |
|---|---|
| ***A63B 71/00*** | (2006.01) |
| ***A63B 26/00*** | (2006.01) |
| ***A63B 23/12*** | (2006.01) |
| ***A63B 21/00*** | (2006.01) |
| *A63B 71/06* | (2006.01) |

(52) U.S. Cl.

CPC ..... *A63B 23/1236* (2013.01); *A63B 21/1473* (2013.01); *A63B 2071/0625* (2013.01); *A63B 2220/17* (2013.01)

(58) Field of Classification Search

CPC ..... A63B 23/12; A63B 23/1209; A63B 23/1236; A63B 26/00

USPC ..... 482/92, 121, 126, 128, 141, 142

See application file for complete search history.

(56) References Cited

U.S. PATENT DOCUMENTS

| | | | | |
|---|---|---|---|---|
| 2,494,094 | A * | 1/1950 | Horstman | 482/128 |
| 2,666,640 | A * | 1/1954 | Jennings, Sr. | 482/141 |
| D251,288 | S | 3/1979 | Myers | |
| 4,826,151 | A * | 5/1989 | Nuredin | 482/68 |
| 4,900,015 | A * | 2/1990 | Dissinger | 482/141 |
| 5,226,868 | A | 7/1993 | Montgomery | |
| 5,242,355 | A * | 9/1993 | Costa | 482/141 |
| 5,421,800 | A * | 6/1995 | Mullen | 482/121 |
| D363,442 | S * | 10/1995 | Mullinix | D10/97 |
| 5,503,101 | A * | 4/1996 | Mullinix | 116/67 R |
| 5,582,565 | A * | 12/1996 | Soria | 482/141 |
| 5,632,707 | A | 5/1997 | Daniel et al. | |
| 5,643,162 | A * | 7/1997 | Landers et al. | 482/131 |
| 5,890,997 | A | 4/1999 | Roth | |
| 6,120,421 | A * | 9/2000 | Kuo | 482/111 |
| 6,129,651 | A * | 10/2000 | Denaro | 482/141 |
| 6,229,764 | B1 * | 5/2001 | Tongue | 368/110 |
| D467,632 | S | 12/2002 | Berns | |
| 6,543,247 | B2 | 4/2003 | Strauss | |
| 6,663,547 | B1 | 12/2003 | Hughes | |
| 6,976,943 | B1 | 12/2005 | Hsiung | |
| 7,052,449 | B2 * | 5/2006 | Chen | 482/146 |

(Continued)

OTHER PUBLICATIONS

Restriction Requirement for U.S. Appl. No. 29/439,802, mailed Jan. 28, 2014, 5 pages.

(Continued)

*Primary Examiner* — Stephen Crow
*Assistant Examiner* — Garrett Atkinson
(74) *Attorney, Agent, or Firm* — Merchant & Gould P.C.

(57) ABSTRACT

A push up device includes a support device including a base for positioning on the floor, side supports and a top. A control device at the top includes a push up counter, a timer, and/or an audio signaling device. The support device includes adjustable arms which adjust the relative height between the top and the base. Hand supports extend from opposite sides of the support device. In one embodiment, the hand supports are removably mounted from the support device.

16 Claims, 11 Drawing Sheets

(56) References Cited

U.S. PATENT DOCUMENTS

| | | | | |
|---|---|---|---|---|
| 7,318,793 | B2 * | 1/2008 | Dubrul et al. | 482/141 |
| 7,377,888 | B2 | 5/2008 | Godbold | |
| 7,468,025 | B2 | 12/2008 | Hauser et al. | |
| D587,612 | S | 3/2009 | Mills et al. | |
| 7,553,267 | B1 | 6/2009 | Hauser et al. | |
| D597,153 | S | 7/2009 | Friedman et al. | |
| D599,417 | S | 9/2009 | Friedman et al. | |
| 7,604,582 | B2 | 10/2009 | Abdallah | |
| 7,618,358 | B2 * | 11/2009 | Traub et al. | 482/147 |
| 7,645,221 | B1 * | 1/2010 | Curry | 482/148 |
| 7,803,096 | B2 * | 9/2010 | Mehta | 482/140 |
| 8,088,052 | B1 * | 1/2012 | Sprague | 482/141 |
| D662,997 | S | 7/2012 | Su | |
| 2004/0102296 | A1 * | 5/2004 | Dubrul et al. | 482/141 |
| 2005/0009677 | A1 * | 1/2005 | Yang | 482/142 |
| 2005/0020418 | A1 * | 1/2005 | Lin | 482/142 |
| 2005/0227836 | A1 * | 10/2005 | Wen | 482/141 |
| 2005/0245371 | A1 * | 11/2005 | Chen | 482/141 |
| 2005/0250628 | A1 * | 11/2005 | Goldstein | 482/141 |
| 2006/0035771 | A1 | 2/2006 | Gant | |
| 2006/0040808 | A1 * | 2/2006 | Riazi | 482/141 |
| 2007/0129226 | A1 * | 6/2007 | Leavitt | 482/129 |
| 2007/0298947 | A1 * | 12/2007 | Eksteen | 482/141 |
| 2009/0186750 | A1 | 7/2009 | Hauser et al. | |
| 2009/0186751 | A1 | 7/2009 | Hauser et al. | |
| 2010/0113225 | A1 * | 5/2010 | Mills et al. | 482/8 |
| 2011/0160026 | A1 * | 6/2011 | Perez, Jr. | 482/142 |
| 2011/0275499 | A1 * | 11/2011 | Eschenbach | 482/141 |
| 2013/0123081 | A1 * | 5/2013 | Boland | 482/141 |

OTHER PUBLICATIONS

Amazon.com: Perfect Pushup Counter: Sports & Outdoors, http://www.amazon.com/Perfect-Pushup-PA6301-Counter/dp/B001LO0F98S, 5 pages (Date Printed Nov. 2, 2012).

AssessPro® Rep-Addition™ Push-Up Tester, http://www.gophersport.com/products/item_detail.cfm?item_id=9447, 1 page (Copyright 2012).

Konami's push-up counter keeps you motivated, http://www.engadget.com/2007/10/13/konamis-push-up-counter-keeps-you-motivated, 1 page (Oct. 13, 2007).

Perfect Pushup Counter Makes Workouts More Effective, http://inventorspot.com/articles/perfect_pushup_counter_makes_workouts_more_effectiv . . . , 3 pages (Date Printed Nov. 2, 2012).

Photographs of a Perfect Pushup commercial product for the "Perfect Counter", including photographs of the product, the packaging, and the product literature, 15 pages (2008).

Pushup Counter Will Help Your Keep Track of Your Pushups, http://www.ubergizmo.com/2010/02/pushup-counter-will-help-your-keep-track-of-your-p . . . , 3 pages (Feb. 10, 2010).

Design U.S. Appl. No. 29/439,802, filed Dec. 14, 2012 entitled Push Up Device.

* cited by examiner

PUSH UP DEVICE

FIELD OF THE INVENTION

The present invention relates to a push up device for use for exercise or therapeutic activates involving push ups.

BACKGROUND

Push ups are commonly done exercises for children and adults. Push ups can be done without any equipment if desired. Equipment has been developed for promoting proper technique and/or for promoting counting for recordation or tracking purposes. Continued improvements in this area are desired.

SUMMARY

One aspect of the present invention includes a push up device including a support device which includes a base for resting on a floor surface and an upright portion which holds a user engagement device at a spaced apart distance from the floor. The user engagement device can include a control device which may include a user contacting element and one or more of the following: a timer, a counter, and/or an audible signaling device. The contacting element registers when a push up has been completed.

The support device may be adjustable in height to accommodate users who desire that the contacting element be positioned at a different height relative to the floor.

The push up device may include hand supports connected to the support device which holds the user engagement device.

In one embodiment, the hand supports are separately mounted to the support device.

In one embodiment, the support device includes two opposite sidewalls made from flexible materials which promote collapsing of the top downwardly in the event the user falls or uncontrollably contacts the support device to prevent breakage of the device and/or injury to the user.

DETAILED DESCRIPTION OF THE PREFERRED EMBODIMENT

Figure 1:
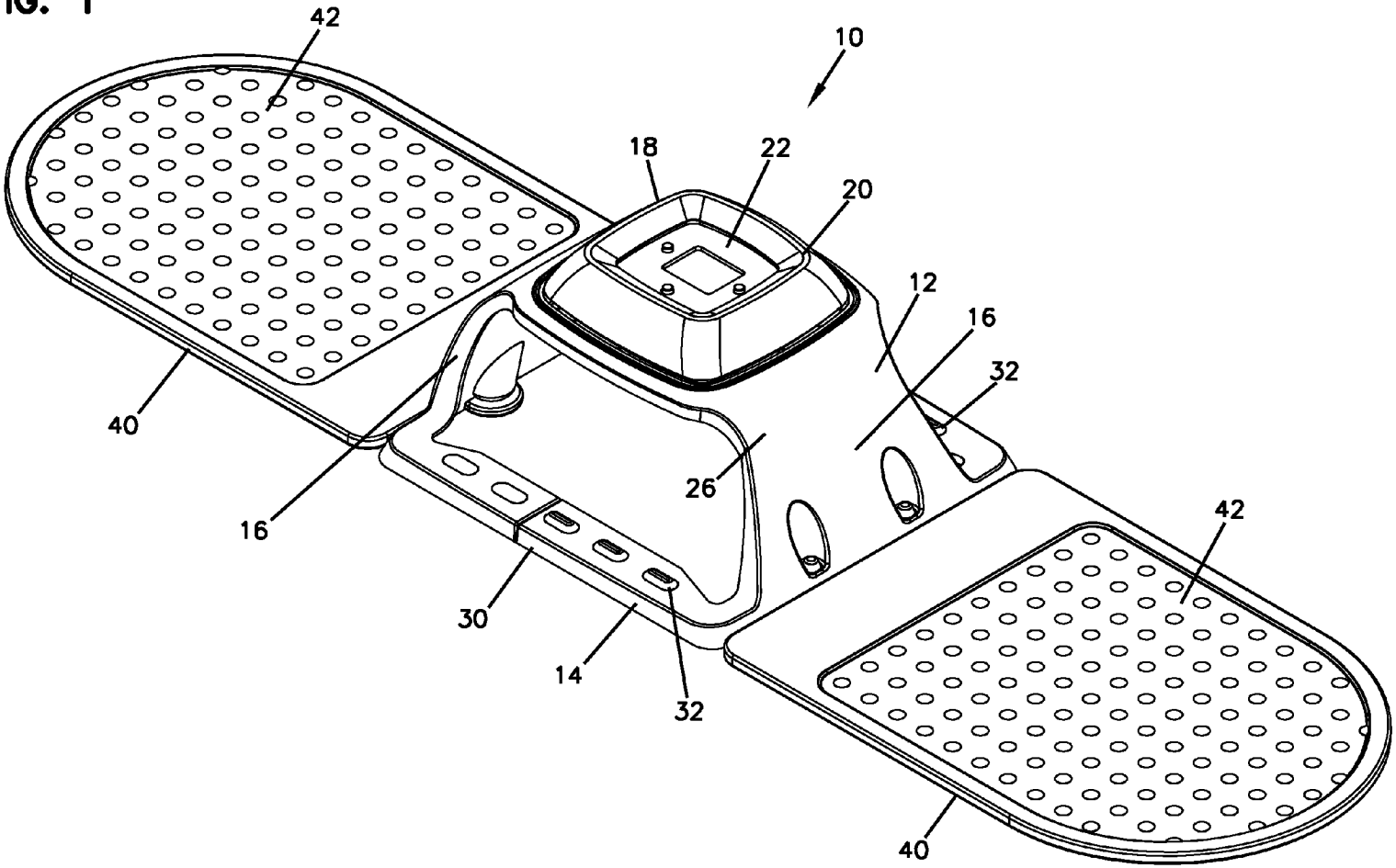
FIG. 1 is a perspective view of a push up device in accordance with the present invention.
Figure 2:
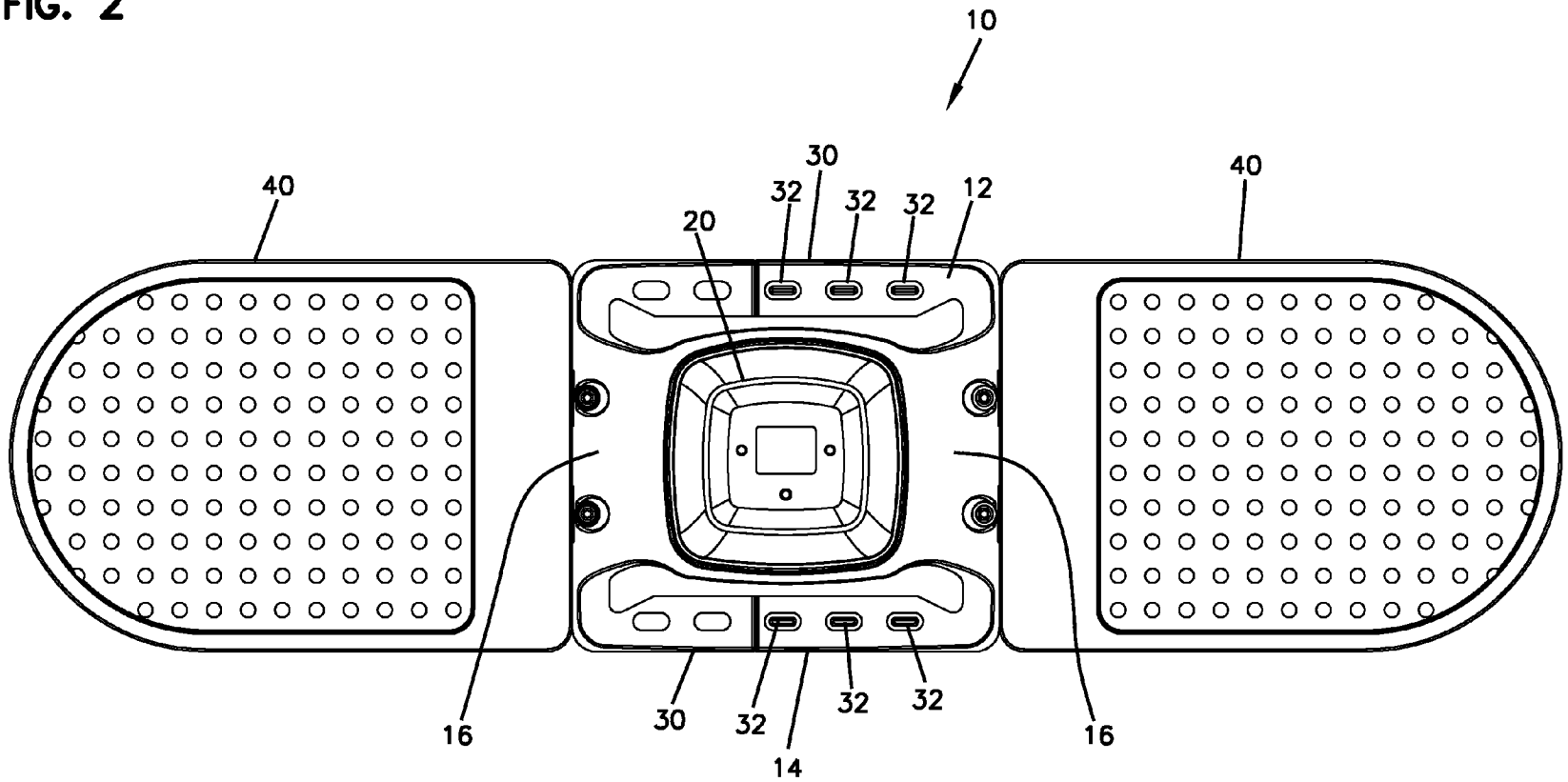
FIG. 2 is a top view of the push up device of FIG. 1.
Figure 3:
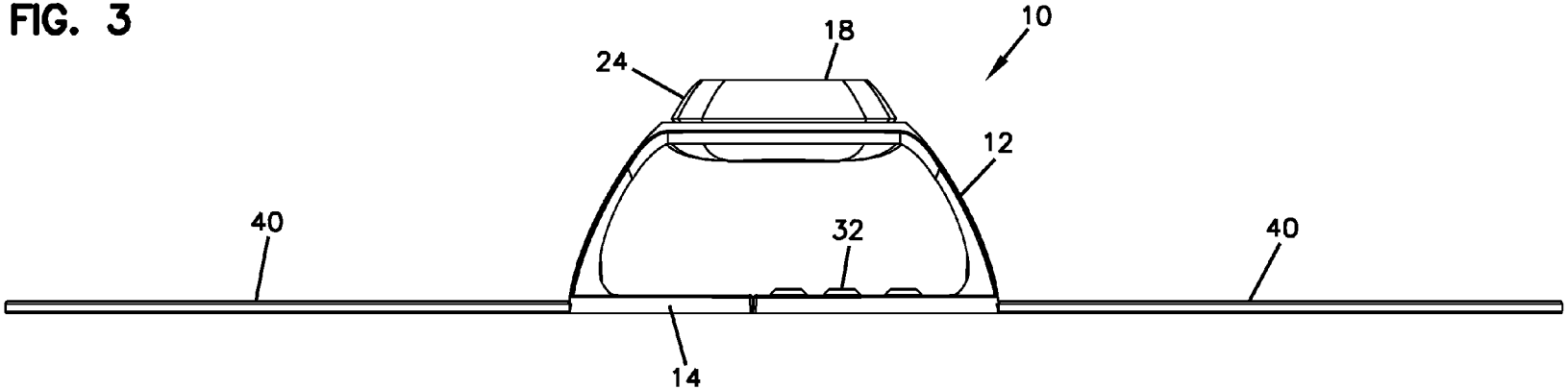
FIG. 3 is a first side view of the push up device of FIG. 1.
Figure 4:
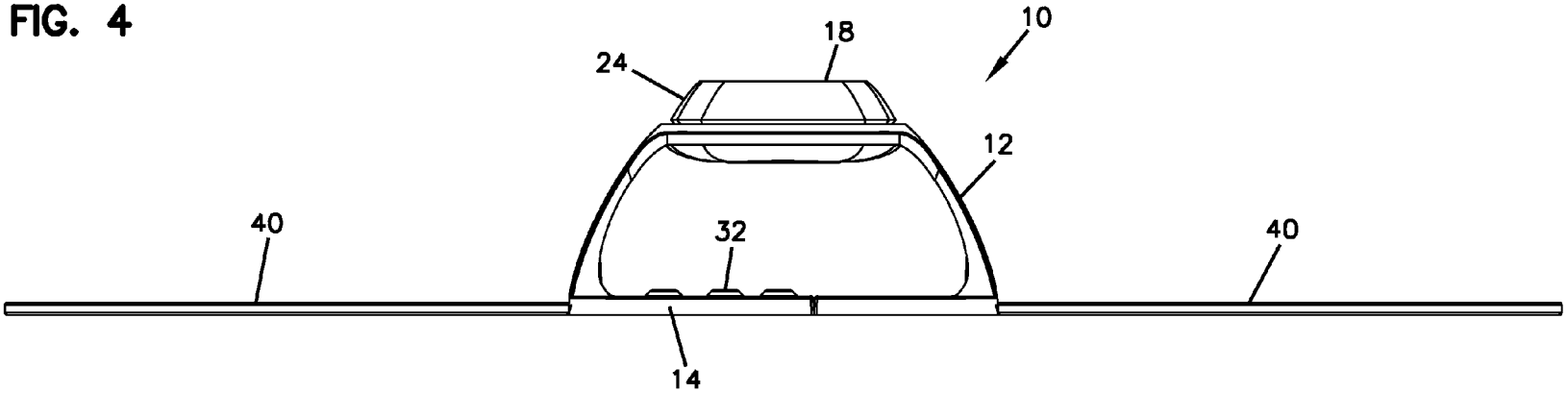
FIG. 4 is a further side view of the push up device of FIG. 1, opposite to the side view of FIG. 3.
Figure 5:
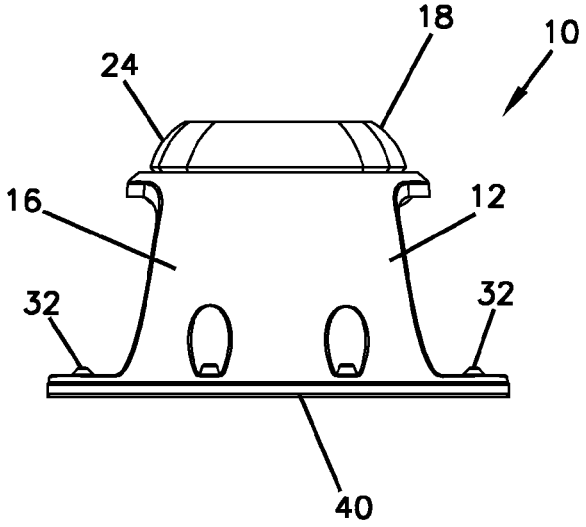
FIG. 5 is another side view of the push up device of FIG. 1.
Figure 6:
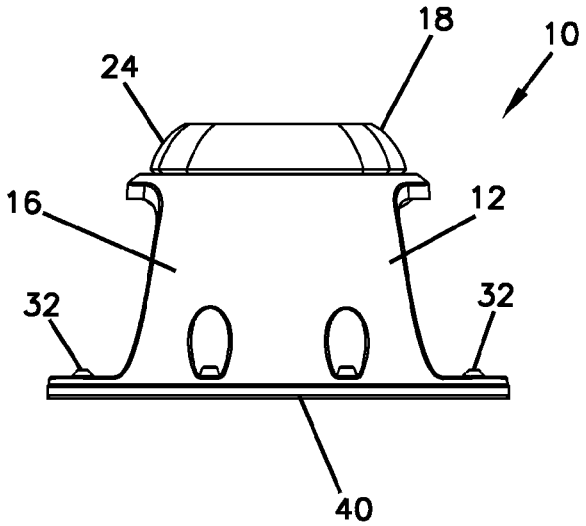
FIG. 6 is a further side view of the push up device of FIG. 1, opposite to the side view of FIG. 5.
Figure 7:
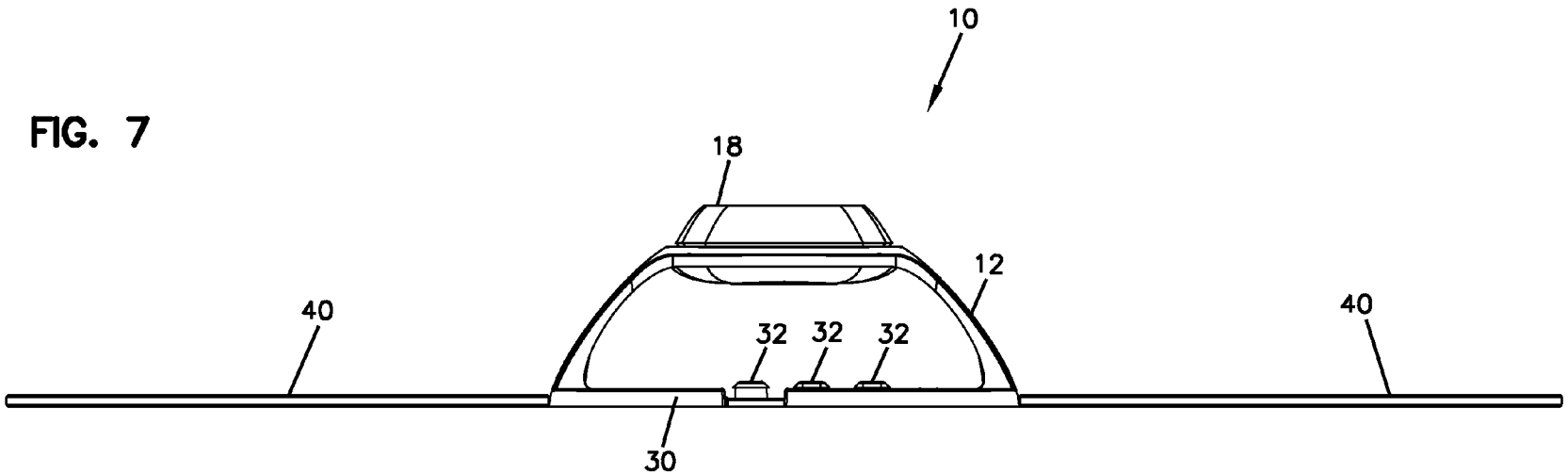
FIGS. 7 and 8 show the adjustability of the support device of FIG. 1 in a first lower position for the user contacting element.
Figure 8:
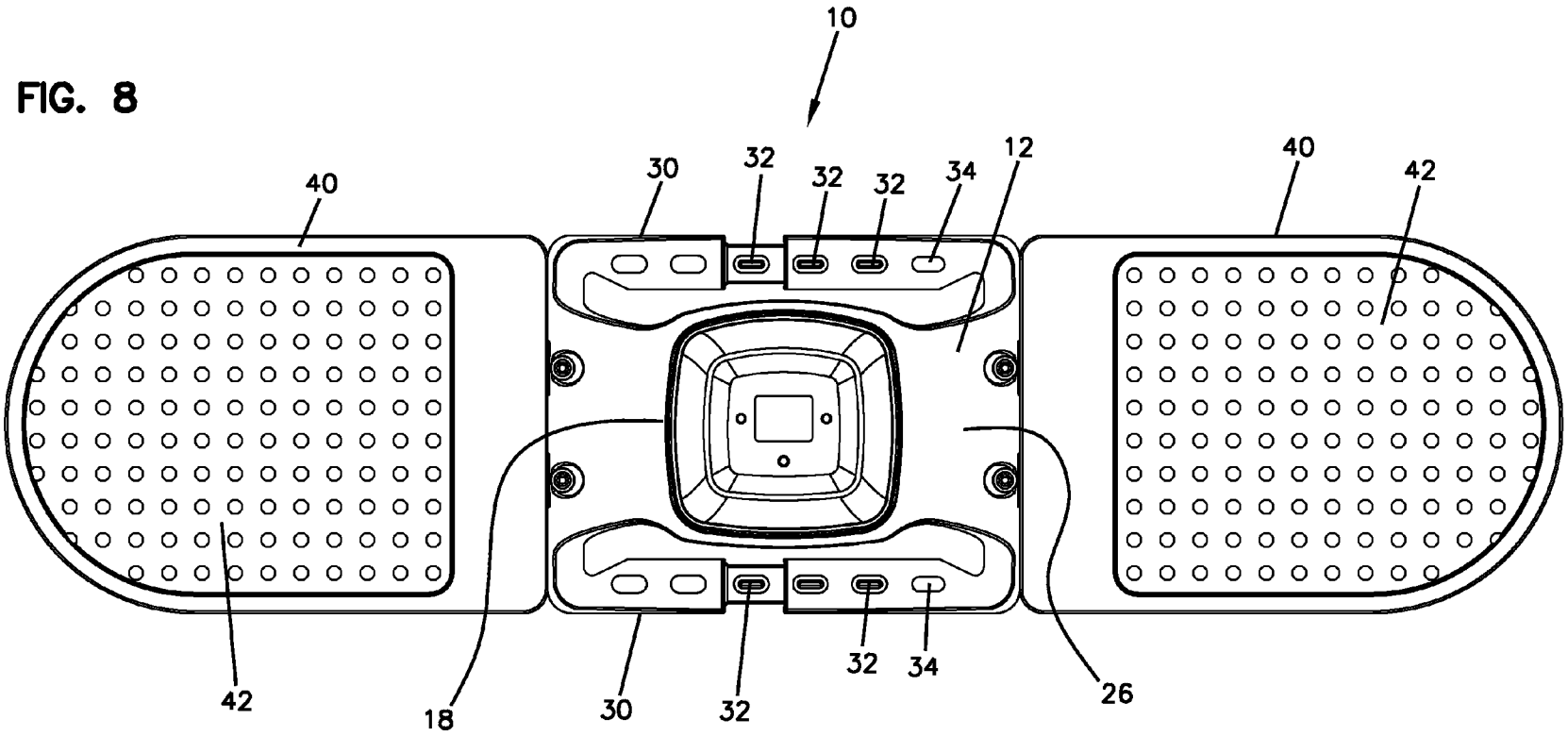
Figure 9:
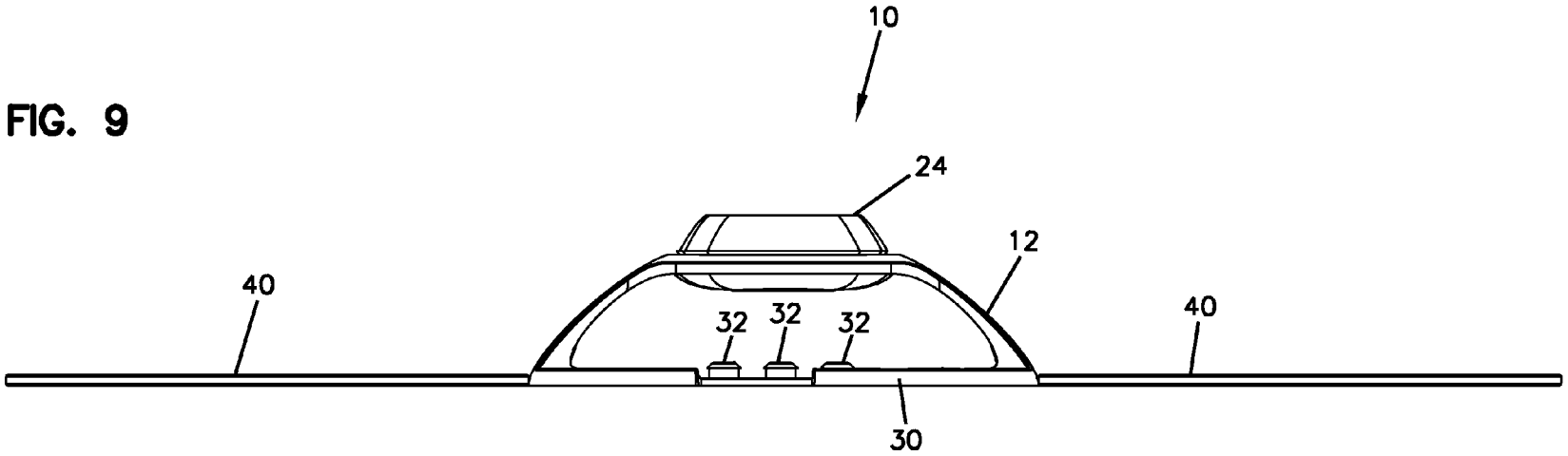
FIGS. 9 and 10 show the adjustability of the support device of FIG. 1 in a second lower position for the user contacting element.
Figure 10:
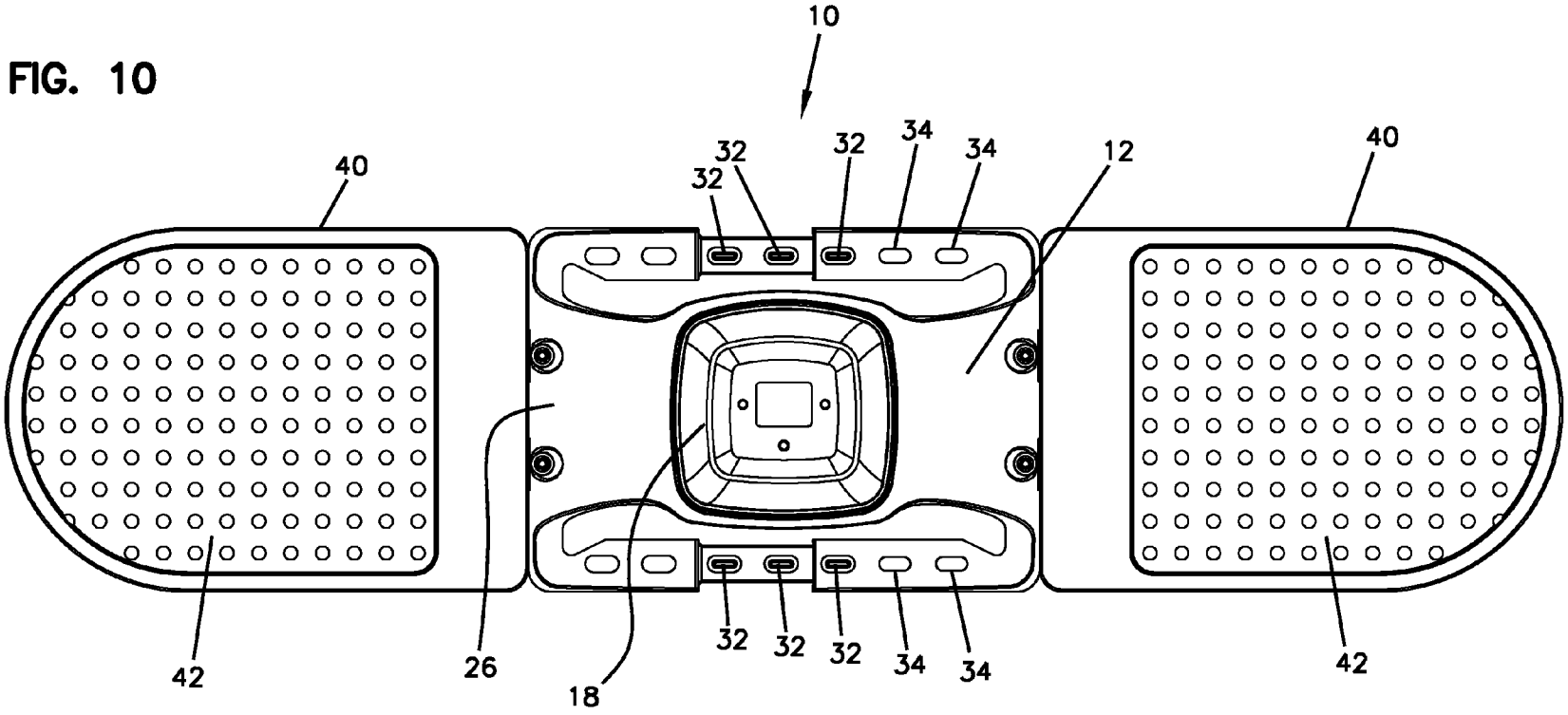
Figure 11:
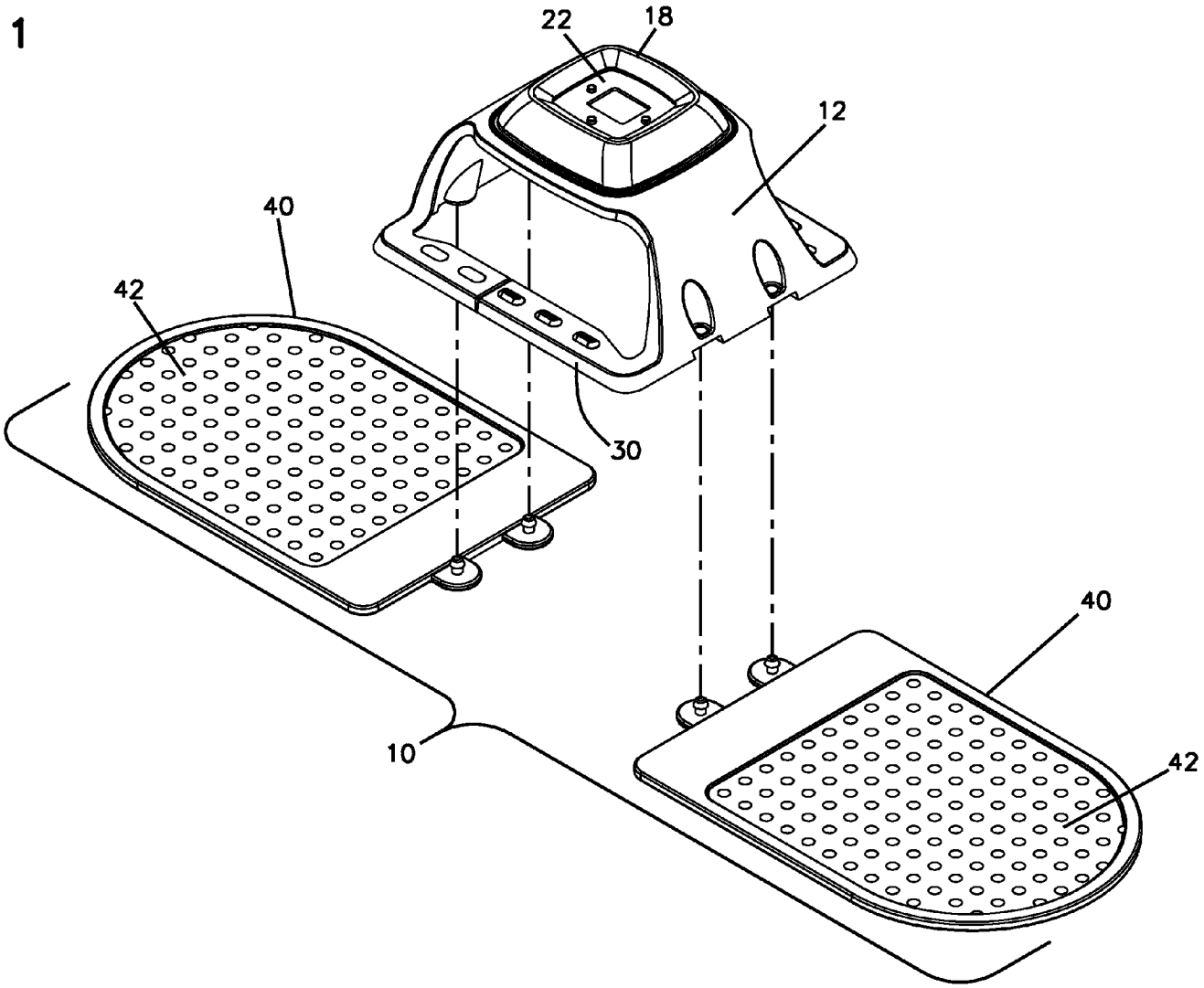
FIG. 11 shows the separate hand supports of the push up device.
Figure 12:
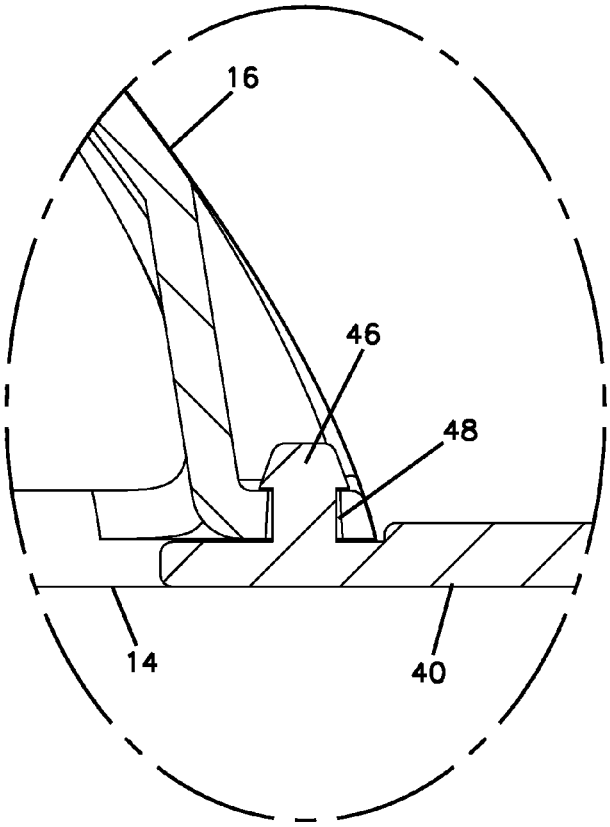
FIG. 12 shows in cross-section one of the mounting arrangements between a hand support and the support device.
Figure 13:
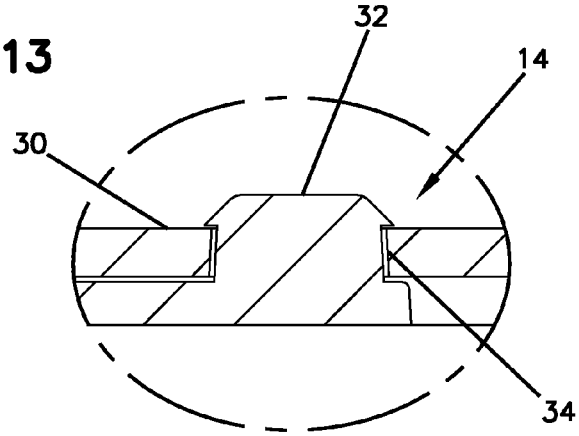
FIG. 13 shows in cross-section one of the mounting arrangements of the support device for adjusting the height.
Figure 14:
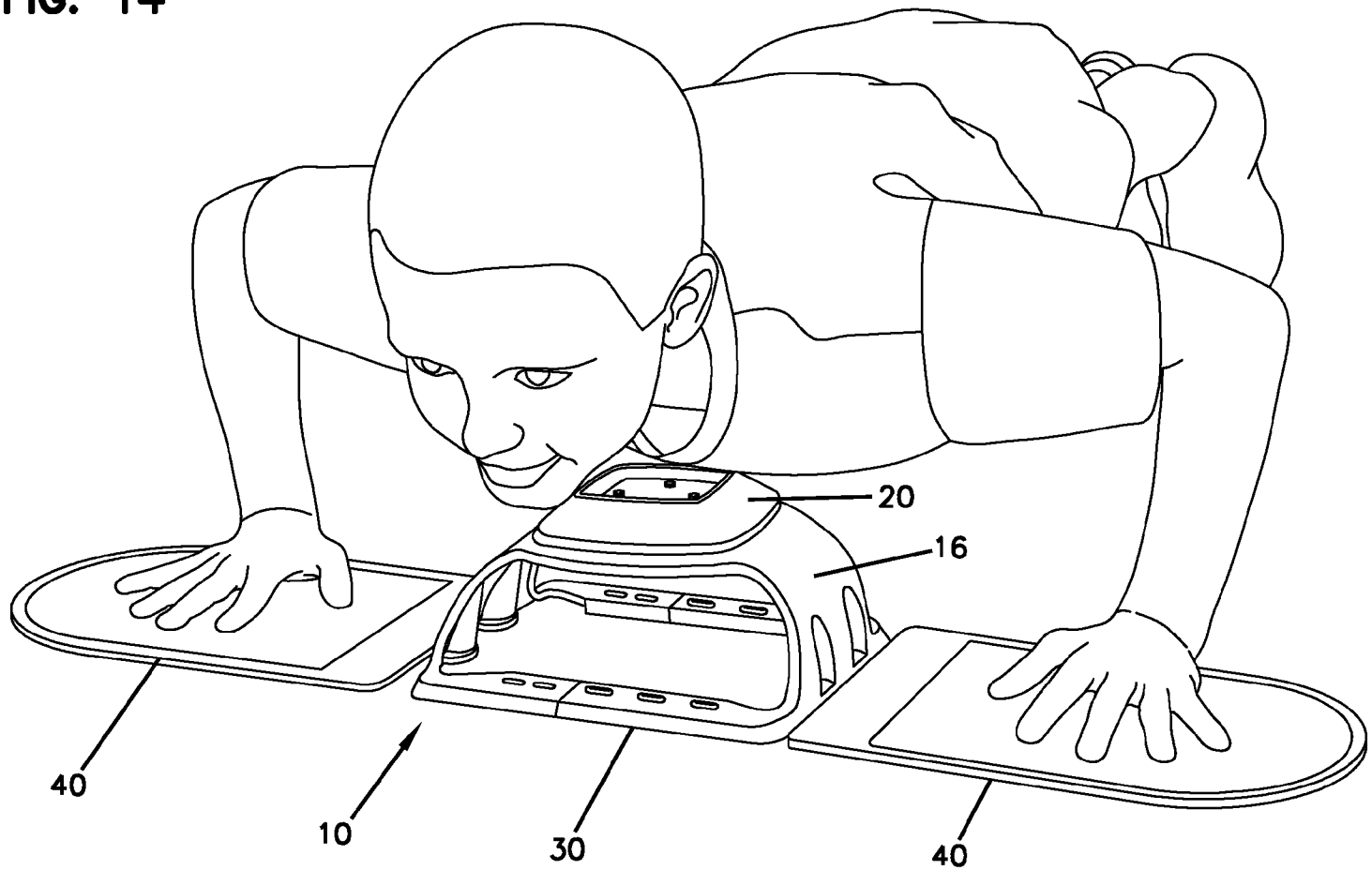
FIG. 14 shows the push up device of FIGS. 1-13 during use by a user doing a push up.

A push up device 10 is shown in FIGS. 1-13. The push up device includes a support device 12 with a base 14 for positioning on a floor surface. Extending upward from base 14 is an upright portion in the form of two side supports 16 which extend to a top 20. Top 20 includes a control device 22. Control device 22 can include one or more of the following features and functions: a counter, a timer, an audio signaling device. Control device 22 includes a user engagement device or portion 18 which the user contacts to register the completion of a push up.

Control device 22 includes a pressure sensitive top element 24 which is contacted by the user when the user moves downwardly to do a push up exercise. One example may include a spring biased portion and a sensor that senses contact when the spring bias is overcome during movement. Upon contacting top element 24, a sensor within control device 22 registers the completion of a push up. The control device 22 can count push ups upwardly from a desired number such as zero (0), downwardly from a desired number such as 10, 25, 100, or other, or relative to a timer. An audio signal can be combined with the counting and the timing functions, or used separately.

Support device 12 includes a body construction 26 from flexible material such that if the user falls onto support device 12 or collapses onto support device 12 during exercise, support device 12 is not broken, and/or does not injure the user. For example, side supports 16 can each collapse toward one side or the other which causes a corresponding lowering of control device 22 toward the floor.

Support device 12 is adjustable such that control device 22 can be positioned at different heights relative to the floor. The length of base 14 can be changed. Due to the flexible construction of body construction 26, changing the length of base 14 causes a corresponding change in the height of top 20. Compare FIGS. 3 and 4 with FIGS. 7 and 9. Base 14 includes arms 30 which are adjustable in length. Compare FIGS. 2-4 with FIGS. 7 and 8, and FIGS. 9 and 10. Locking tabs 32 fit into mating locking slots 34 to hold arms 30 in the desired length. Locking tabs 32 and locking slots 34 releaseably snap together.

Push up device 10 includes hand supports 40 on opposite sides of support device 12. Hand supports 40 provide a location 42 for a user to place their hands during the push up exercise. Hand supports 40 promote proper positioning of support device 12 so as to contact the user adjacent the user's chest. Hand supports 40 also keep the user from contacting the floor which may be dusty, or not clean. Further, hand supports 40 promote a non-slip engagement by the user with push up device 10. Hand supports 40 can be shaped and textured as desired to promote desired gripping and non-slip properties.

In one embodiment, hand supports 40 are separate from support device 12, and are attachable to form a single unit. One method of attachment of hand supports 40 to support device 12 is with locking tabs 46 and mating locking slots 48. Locking tabs 46 and locking slots 48 releaseably snap together.

In one embodiment, a plurality of push up devices 10 can be stacked on top of one another in a compact manner wherein the support devices 12 nest within one another with the top 20 of a lower push up device 10 fitting within support device 12 of an upper device 10.

What is claimed is:

1. A push up device comprising:

a support device including a base and a side support which extends upwardly along a first axis from the base to a top;

a control device positioned at the top for engagement by a user during a push up exercise, the control device including a push up counter; and an adjustable arm coupled to the support device, the adjustable arm being movable along a second axis to one of a plurality of discrete securement positions, the second axis being orthogonal to the first axis, wherein movement of the adjustable arm between securement positions adjusts a distance between the top and the base to be one of a plurality of different discrete heights, wherein the adjustable arm can be releasably secured at any of the securement positions.

2. The push up device of claim 1, wherein the plurality of different heights includes two.

3. The push up device of claim 1, wherein the plurality of different heights includes three.

4. The push up device of claim 1, further comprising hand supports mounted to the support device.

5. The push up device of claim 4, wherein the hand supports are removably mounted to the support device.

6. The push up device of claim 5, wherein the hand supports are removably mounted to the support device with a locking tab and slot arrangement.

7. The push up device of claim 1, wherein the adjustable arm is one of two adjustable arms of the base.

8. The push up device of claim 7, wherein the adjustable arms of the base device include a locking tab and slot arrangement.

9. The push up device of claim 1, wherein the side support is one of two side supports disposed opposite one another, wherein the support device is made from a flexible material which collapses the top toward the base if the user falls onto the support device or collapses during a push up.

10. A push up device comprising:

a support device including a base and a side support which extends upwardly along a height of the support device from the base to a top, wherein the height of the support device is adjustable by changing a length of the base, the length of the base being orthogonal to the height of the support device;

a control device positioned at the top for engagement by a user during a push up exercise, the control device including a push up counter;

first and second hand supports extending from opposite sides of the support device, the hand supports being shaped and configured to provide a location for hands of the user during the push up exercise.

11. The push up device of claim 10, wherein the side support is one of two side supports disposed opposite one another, wherein the support device is made from a flexible material which collapses the top toward the base if the user falls onto the support device or collapses during a push up.

12. The push up device of claim 10, wherein the hand supports are removably mounted to the support device.

13. The push up device of claim 12, wherein the hand supports are removably mounted to the support device with a locking tab and slot arrangement.

14. A method of using a push up device comprising:

positioning a push up device on a surface, the push up device including a support device having a base, a top, and a side support extending from the base to the top; a control device positioned at the top for engagement by a user during a push up exercise, the control device including a push up counter; and adjustable arms which adjust a distance between the top and the base to one of a plurality of different heights; and adjusting a length of the adjustable arms to adjust the distance of the top relative to the base, wherein the length of the adjustable arms is adjusted generally orthogonal to the distance between the top and the base.

15. The method of claim 14, further comprising releasably securing the adjustable arms at the length prior to performing the push up exercise.

16. A method of using a push up device comprising:

positioning a push up device on a surface, the push up device including a support device having a base that seats on the surface, a top, and a side support extending from the base to the top; and a control device positioned at the top for engagement by a user during a push up exercise, the control device including a push up counter;

adjusting a distance between the top and the base by adjusting a length of the base along the surface; and mounting a plurality of hand supports to the support device including releasably mounting a first hand support to a first side of the support device and releasably mounting a second hand support to a second side of the support device, the second side being opposite the first side.

* * * * *